United States Patent [19]

Saito et al.

[11] Patent Number: 4,676,763

[45] Date of Patent: Jun. 30, 1987

[54] ROLLING AND WALKING TOY VEHICLE

[75] Inventors: Makato Saito; Hiroyuki Watanabe, both of Tateishi, Japan

[73] Assignee: Tomy Kogyo Co, Inc., Tokyo, Japan

[21] Appl. No.: 815,064

[22] Filed: Dec. 31, 1985

[30] Foreign Application Priority Data

May 24, 1985 [JP] Japan ..... 60-77483[U]

[51] Int. Cl.[4] ..... A63H 11/18; A63H 31/08

[52] U.S. Cl. ..... 446/230; 446/353; 446/441; 446/463

[58] Field of Search ..... 446/463, 470, 487, 441, 446/230, 231, 354, 355, 353

[56] References Cited

U.S. PATENT DOCUMENTS

| | | | |
|---|---|---|---|
| 2,917,866 | 12/1959 | Ullmann | 446/230 X |
| 3,546,809 | 12/1970 | Nielsen | 446/470 X |
| 4,529,391 | 7/1985 | Hoshino et al. | 446/487 X |
| 4,543,073 | 9/1985 | Matsuda | 446/487 X |
| 4,555,237 | 11/1985 | Nikaido | 446/355 |

FOREIGN PATENT DOCUMENTS

| | | | |
|---|---|---|---|
| 1097875 | 1/1961 | Fed. Rep. of Germany | 446/353 |
| 1265903 | 5/1961 | France | 446/354 |

*Primary Examiner*—Robert E. Bagwill
*Assistant Examiner*—Terrence L. B. Brown
*Attorney, Agent, or Firm*—Staas & Halsey

[57] ABSTRACT

A toy vehicle is provided, including: a body; a spring, power generating unit connected to the body; a plurality of driving wheels connected to the spring, power generating unit through a transmission; a pair of legs mechanically connected to the spring, power generating unit through the transmission; a crank mechanism connected to the legs; a speed control gear mechanism capable of being connected to or disconnected from the transmission by automatic switching motion of a planetary gear meshing with a first gear of the transmission; and a movable actuating member, one end of which contacts the ground when the driving wheels contact the ground, thus moving the other end of the actuating member which disengages the planetary gear from the speed control gear mechanism. When the toy vehicle is placed in the horizontal position on the ground and the spring, power generating unit is wound via forced rotation of the driving wheels, the actuating member is moved to disengage the planetary gear from the speed control gear mechanism and the vehicle is propelled to roll at a high speed. If the toy is then lifted so as to isolate the driving wheels from the ground, the planetary gear moves and meshes with the speed control gear mechanism to shift the mechanism to the low speed mode. Then the driving wheels and the walking legs move at a low speed. If the toy vehicle is then placed in the vertical position on its walking legs, the toy vehicle walks slowly.

7 Claims, 9 Drawing Figures

ROLLING AND WALKING TOY VEHICLE

BACKGROUND OF THE INVENTION

The present invention relates to a toy vehicle and, more particularly, to a toy vehicle which can both walk in a vertical position and be propelled to roll in a horizontal position.

A combination walking/rolling toy vehicle is required to switch between a walking mode at a slow speed and a rolling mode at a higher speed in order to heighten the user's interest. If the speed mode switching means is manual, play must be interrupted to switch modes and interest is lessened. In addition, if a speed control gear mechanism is used with spring biased wheels to effect speed mode changes, and the speed control gear mechanism remains in its actuating position when the spring is wound by forcibly rotating the driving wheels, the speed control gear mechanism may suffer considerable stress and the gears thereof may be broken.

SUMMARY OF THE INVENTION

Accordingly, it is a primary object of the present invention to provide a combination walking/rolling toy vehicle equipped with a switching mechanism capable of switching speed modes efficiently and automatically in a relatively simple manner.

To achieve the foregoing and other objects of the present invention and in accordance with the purposes of the invention, the combination walking/rolling toy vehicle of the present invention includes: a body formed in any desired shape, such as an airplane; a spring, power generating unit attached to the body; a plurality of driving wheels connected to the spring, power generating unit through a transmission; a pair of legs mechanically connected to the spring, power generating unit through the transmission and a crank mechanism so that power is fed to the legs to execute a walking motion; a speed control gear mechanism which is connected to and disconnected from the transmission by a switching motion of a planetary gear which meshes with one of the gears of the transmission and which moves in the revolutional direction of the transmission; and a movable actuating member, a first end of which contacts the ground when the body is placed in the horizontal position and the driving wheels contact to the ground, thus moving the actuating member second end to disengage the planetary gear the speed control gear mechanism. Thus, the speed control gear mechanism is no longer connected to the power, thereby keeping the gears of the speed control gear mechanism free from load. The toy vehicle may then be propelled to roll via the driving wheels in a horizontal position at a high speed, since the power is not transmitted through the speed, control gear unit.

On the other hand, after the spring has been wound up in the above-mentioned manner and the toy vehicle is lifted into a vertical position so as to isolate the driving wheels from the ground, the planetary gear engages the speed control gear mechanism so that the speed control gear mechanism shifts to the low speed. After the toy vehicle is lifted, but before it is placed vertically on the ground, power loss is reduced since the driving wheels and the walking legs are isolated from the ground. Finally, when the toy vehicle is placed in the vertical position with the legs contacting the ground, the toy vehicle walks at the slow speed.

As can be seen from the above, the present invention provides a toy vehicle which can be easily and automatically switched from a walking mode to a rolling mode, thus eliminating damage to the switching mechanism and increasing overall interest in the toy.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
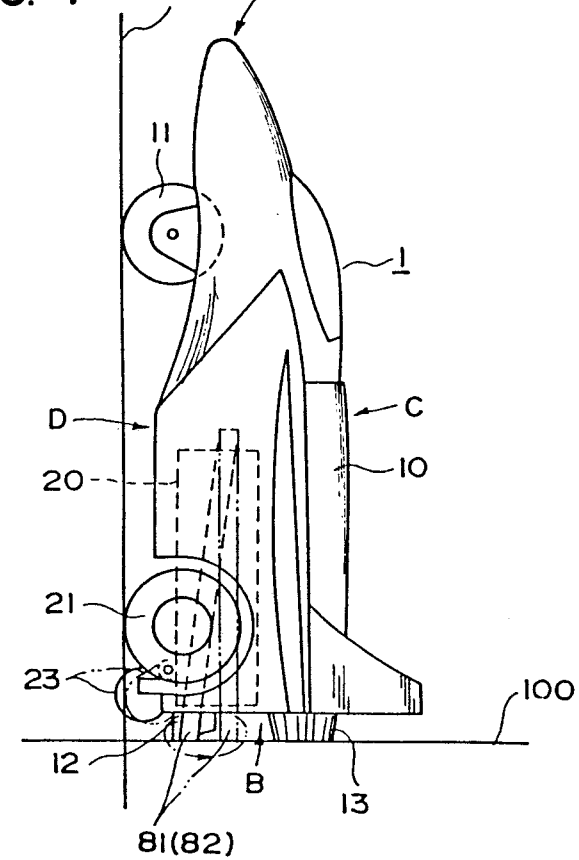
FIG. 1 is a side view of the walking/rolling toy vehicle oriented relative to both the horizontal and vertical planes.
Figure 3:
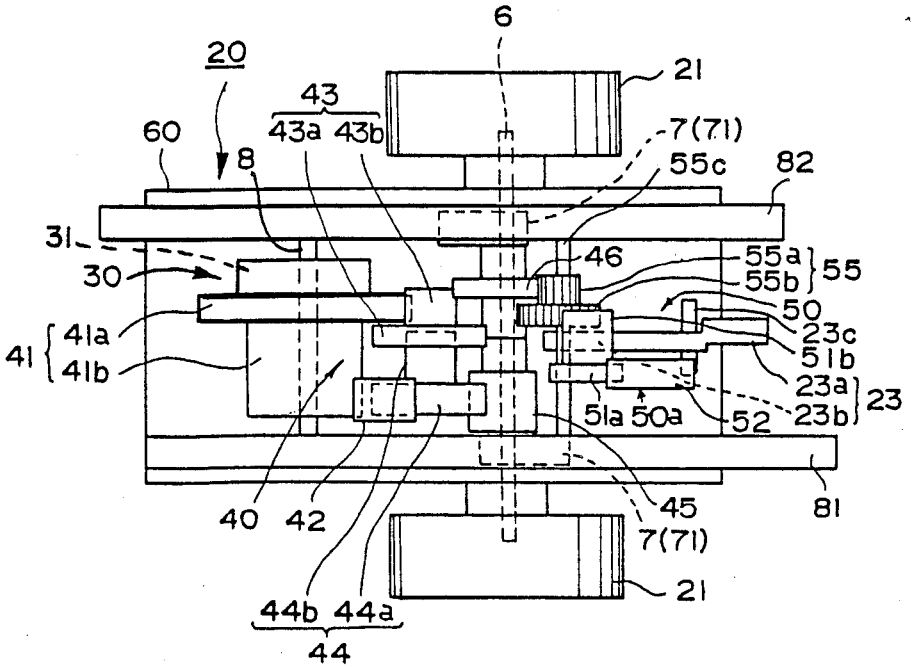
FIG. 3 is a longitudinal sectional view of the inner mechanism of the toy vehicle.
Figure 4:
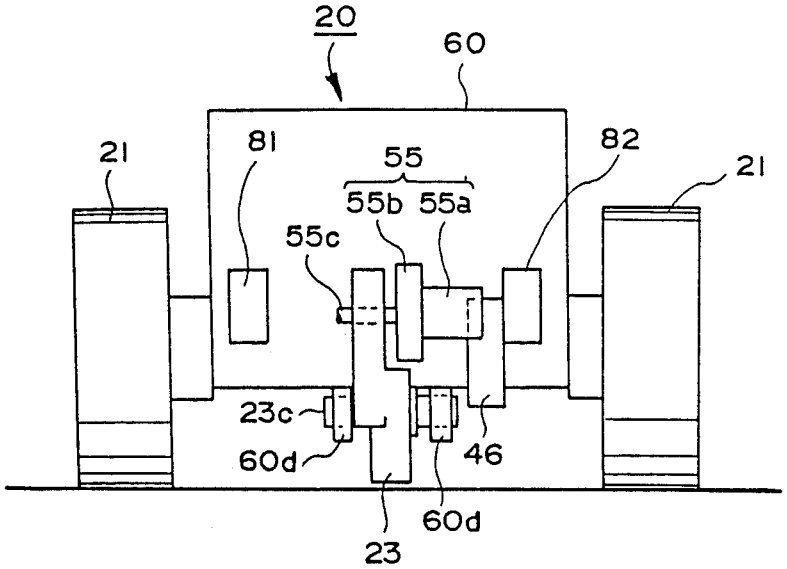
FIG. 4 is a rear, transversal sectional view of the inner mechanism of the toy vehicle.

FIG. 1 is a side view showing the walking/rolling toy vehicle 1, wherein the reference characters A, B, C and D denote the front, rear, top and bottom, respectively. This walking/rolling toy vehicle 1 includes generally: a housing or body 10; a non-driven wheel 11 rotatably arranged under the front center bottom of the body 10; and a spring, power generating unit 20 disposed in the rear lower portion of the body 10, and driving wheels rotatably mounted to the body 10.

In general, this walking/rolling toy vehicle 1 is placed on the ground or floor 100 in a horizontal position so that the front wheel 11 and the pair of driving wheels 21 contact the ground 100. The driving wheels 21 are then forcibly rotated by pushing the body 10 along the ground 100 in order to wind a spring power generator or spring 30 of the spring power generating unit 20. This spring power generator 30 will be described later in detail. In this wound condition, if the body 10 is placed in a horizontal position on the ground and released, it rolls forward at a high speed. On the other hand, when the toy vehicle 1 is placed in the vertical position, the actuating member 23 switches the toy vehicle 1 from the above-described high speed mode to a low speed mode. When the toy vehicle is then oriented such that the pair of walking legs 81, 82 contacts the ground, the toy vehicle 1 walks slowly via the walking motion of the pair of walking legs 81, 82.

The structure of the walking/rolling toy vehicle 1 will now be described in great detail.

Figure 2:
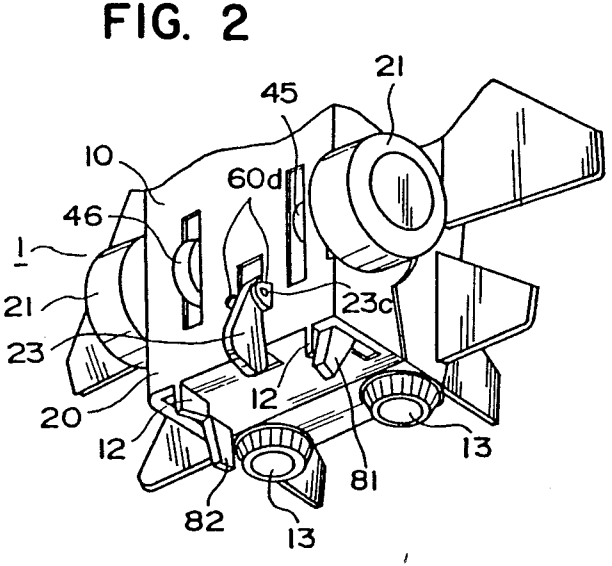
FIG. 2 is a partial, perspective view showing the lower rear section of the toy vehicle.

In the illustrative embodiment shown in FIG. 1, the body 10 is formed to represent an airplane with a hollow interior. The wheel 11 is rotatably arranged at the front bottom of the body 10. A pair of auxiliary legs 12 is arranged near the rear, bottom of the body 10 and a pair of standing support members 13 is arranged near the rear top as shown in FIGS. 1 and 2. The auxiliary legs 12 and the standing support members 13 allow the body 10 to be spaced a predetermined distance from the ground when the body 10 is positioned in the vertical position.

The above-introduced spring, power generating unit 20 is best shown in FIGS. 3 to 6. The spring, power generating unit 20 includes: a casing 60 formed in a hollow box shape; the spring power generator or spring 30; a plurality of gears 41–46 as components of a transmission 40; gears 51*a* and 51*b* and a governor 50*a* as components of a speed control gear mechanism 50; a drive shaft 6 receiving the driving wheels 21 at both ends thereof; a pair of cams 71 as components of a crank mechanism 7; a pair of walking legs 81, 82; and an actuating member 23.

The spring power generator 30 includes: a spiral spring 31, one end of which is fixed to a spring shaft 8 and the other end of which is fixed to the casing 60. When the spring shaft 8 is rotated counter-clockwise in FIG. 5, the spring 31 is wound up. The spring shaft 8 is rotated clockwise in FIG. 5 as the wound spring 31 is released. The spring shaft 8 also receives the gear 41 including a large gear section 41*a* and a small gear section 41*b*.

The above-introduced transmission 40 includes: the gear 41 fixed to the spring shaft 8; the gears 45 and 46 fixed to the drive shaft 6; the gear 44 having a large gear section 44*a* and a small gear section 44*b*, the large gear section 44*a* meshing with the gear 45; the planetary gear 42 meshing with the large gear section 44*a* of the gear 44 and movably supported along the external circumference of the large gear section 41*b* of the gear 41 depending on the movement of the planetary gear 42; and another planetary gear 43 having a large gear section 43*a* and a small gear section 43*b*, the small gear section 43*b* being movably supported along the outer circumference of the large gear section 41*a* so as to mesh with or be released from the small gear section 44*b* according to the movement of the small gear section 43*b*.

The planetary gear 42 is fixed to a pivot 42*a* (FIG. 5) which is movably supported by a pair of arc shaped bearing openings 60*a* formed in both side walls of the unit casing 60, each arc shaped bearing opening 60*a* being a part of a circle about the axis of the gear 44. Also, the planetary gear 43 is fixed to a pivot 43*c* which is movably supported by a pair of arc shaped bearing openings 60*b* formed in both side walls of the unit casing 60, each arc shaped bearing opening 60*b* being a part of a circle about the axis of the gear 41. The transmission 40 is constructed such that power can be transmitted and received between the spring power generator 30 and the drive shaft 6.

Figure 5:
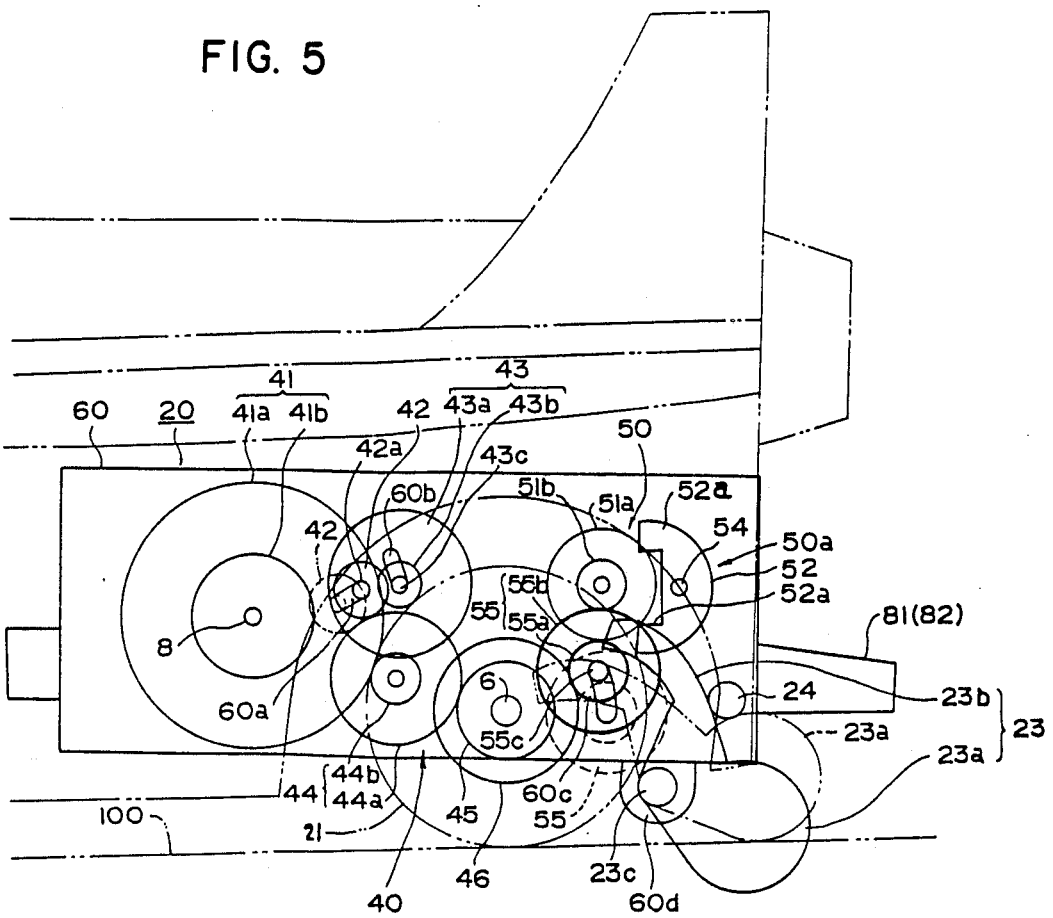
FIG. 5 is a schematic view showing operation of the inner mechanism.

The speed control gear mechanism 50 includes the governor 50*a* and the gear 51*b* which receives revolutional power and drives the governor 50*a*. The governor 50*a* includes the gear 51*a* and a pendulum member 52. The pendulum member 52 has a pair of pawl sections 52*a* at either end (FIG. 5). The pawl sections 52*a* alternatively engage the gear 51*a* so that the pendulum member 52 executes pendulum motion about a pivot 54. The gear 51*b* is integrally fixed to the gear 51*a* so that the gear 51*b* receives revolutional power from a planetary gear 55 (described in detail below).

The planetary gear 55 includes a small gear section 55*a* meshing with the above-described transmission gear 46 and a large gear section 55*b* integrally formed with the small gear section 55*a* and meshing with or being disengaged from the gear 51*b* according to the movement of the small gear section 55*a*. The planetary gear 55 is fixed to a pivot 55*c* (FIG. 5) which is movably (in the vertical direction) supported by a pair of arc shaped bearing openings 60*c* formed in both side walls of the unit casing 60. Each arc shaped bearing opening is a part of circle about the axis of the transmission gear 46. Thereby, the planetary gear 55 can be moved.

According to this structure, the small gear section 55*a* of the planetary gear 55 meshes with the transmission gear 46 and is moved in the same direction of revolution as the transmission gear 46. The large gear section 55*b* meshes with or is released from the gear 51*b* in accordance with the movement of the small gear section 55*a*. That is, when the pair of driving wheels 21 revolve in the direction of winding of the spring 31 of the spring power generator 30, the planetary gear 55 is moved downwards. Thereby, the large gear section 55*b* is released from the gear 51*b*. On the other hand, when the driving wheels 21 revolve counter-clockwise in FIG. 5, i.e., in the rolling direction, the planetary gear 55 is moved upwards. Thus, the large gear section 55*b* meshes with the gear 51*b*, so that the speed control gear mechanism 50 is actuated. As a result, the driving wheels 21 revolve at a low speed.

The actuating member 23 is pivotably supported at the center of a shaft 23*c* which is bridgingly supported between a pair of bearings 60*d*, 60*d* protruding from the rear lower section of the unit casing 60. The actuating member 23 includes: a ground contacting section 23*a* and an arm section 23*b* formed in an arc shape. The ground contacting section 23*a* protrudes downward from the unit casing 60 and the arm section 23*b* is disposed at the upper portion of the pivot 55*c* of the planetary gear 55. The rotating movement of the actuating member 23 is limited within a predetermined area by a pin 24 on the unit casing 60 as shown in FIG. 5.

The ground contacting section 23*a* and the arm section 23*b* of the actuating member 23 are so arranged that the arm section 23*b* pushes the pivot 55*c* upwards to release the planetary gear 55 from the gear 51*b* when the lower end of the ground contacting section 23*a* is positioned on the same surface as the lower ends of the front wheel 11 and the driving wheels 21. In other words, when the walking/rolling toy vehicle 1 is put into a horizontal position by contacting the front wheel 11 and the driving wheels 21 to the ground, the actuating member 23 is rotated counter-clockwise in FIG. 5, so that the lower end of the ground contacting section 23*a* is positioned at the same level as the lower ends of the front wheel 11 and the driving wheels 21. Although the planetary gear 55 is subjected to the lifting force to mesh with the gear 51*b* by the transmission gear 46 revolving counterclockwise in FIG. 5 due to the returning power of the spring 31, the planetary gear 55 is forcibly pushed downwards by the arm section 23*b* of the actuating member 23 to disengage the planetary gear 55 from the gear 51*b*.

The actuating member 23 is always kept in the balanced state, where the movement of the planetary gear 55 owing to the revolution of the transmission gear 46 is not intercepted, except that the actuating member 23 is subjected to the forcible revolutional power counter-clockwise in FIG. 5 as described above.

The relation between the walking legs 81, 82 and the pair of cams 71 of the crank mechanism 7 for making the legs 81, 82 execute the walking motion will now be described.

The cams 71 may be formed in a disk shape and may be eccentrically fixed to the drive shaft 6 near by the inner walls of the unit casing 60, respectively. The right cam 71 is arranged with a phase 180° different than the left cam 71. The walking legs 81, 82 are arranged in parallel, each by the side walls of the unit casing 60, and protrude in a substantially horizontal direction through unnumbered openings (as shown in FIG. 2) formed in both the front and rear end walls of the casing 60.

Figure 6:
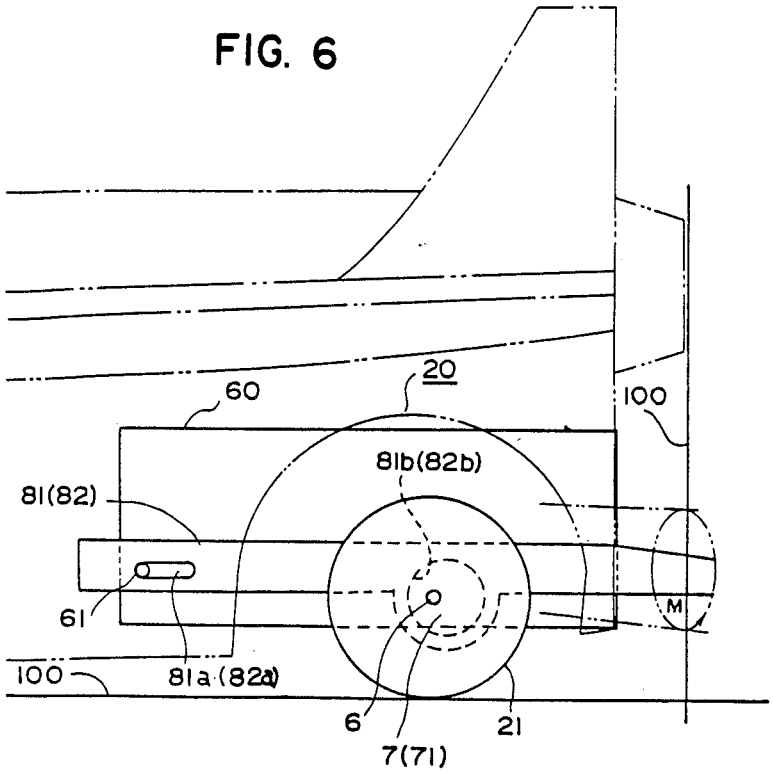
FIG. 6 is a schematic view showing the crank mechanism and the walking legs of the toy.

As shown in FIG. 6, each leg 81 (82) is formed with a longitudinally elongated opening 81*a* (82*a*) near its front end. The elongated opening 81*a* (82*a*) is loosely engaged with a pin 61 horizontally protruding from the inner wall of the casing 60. Each leg 81 (82) is further formed with a large circular opening 81*b* (82*b*) at substantially the center of the leg 81 (82). The large circular opening 81*b* (82*b*) is loosely engaged with a cam 71.

When the cams 71 revolve counter-clockwise in FIG. 6, the walking legs 81, 82 are alternatively moved in a walking motion as represented by the arrow M in FIG. 6.

Although this preferred embodiment employs a spring, power generating unit 20 including a unit casing 60 detachably mounted to the body 10 and the required components for walking and rolling integrally assembled on the casing, the required components may be directly assembled on the body 10, thus excluding the unit casing 60.

In this preferred embodiment, although the crank mechanism 7 is composed of the disk shaped cams 71 so as to cause the legs 81, 82 to move, another means (for example, cranked or bent shafts) capable of making the legs 81, 82 move in the same way may be used for the crank mechanism 7.

Operation of the walking/rolling toy vehicle 1 described above will now be explained in greater detail.

First of all, the walking/rolling toy vehicle 1 is placed in the horizontal position so that the front wheel 11 and the driving wheels 21 contact the ground 100. The toy vehicle 1 in the horizontal position is forcibly moved in the direction represented by the arrow X shown in FIG. 7; i.e., a backwards direction. The driving wheels 21 are rotated clockwise in FIG. 7 and the gear 44 revolves counter-clockwise (represented by the arrow therein) by the gear 45 fixed to the drive shaft 6. The planetary gear 42 meshing with the gear 44 is moved counter-clockwise along the outer circumference of the large gear section 44*a* of the gear 44 and meshes with the small gear section 41*b* of the gear 41 fixed to the spring shaft 8.

Figure 7:
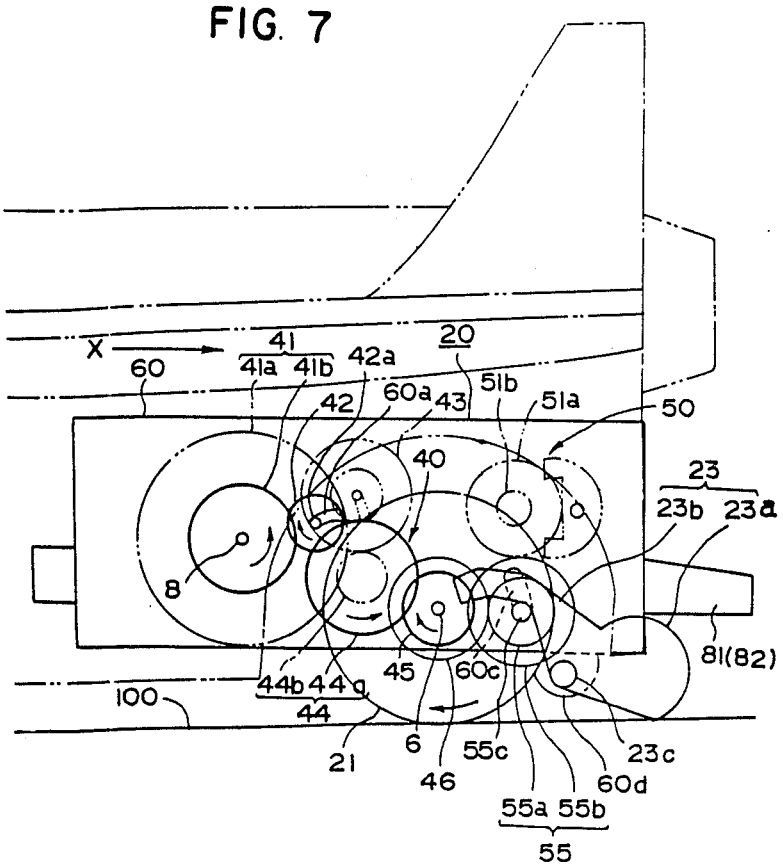
FIG. 7 is a schematic view showing the relation of gear engagement when the spring is wound up.

According to this engagement among the gears, the revolution of the driving wheels 21 is transmitted to the spring shaft 8, so that the spring shaft 8 revolves counter-clockwise in FIG. 7. Thus, the spiral spring 31 fixed to the spring shaft 8 is wound up.

Under this condition, the planetary gear 55 is moved downwards by the revolutional power of the transmission gear 46 revolving clockwise via the driving wheels 21 and the arm section 23*b* of the actuating member 23; the ground contacting section 23*a* contacts the ground 100. The planetary gear 55 is free from transmitting power to the speed control gear mechanism 50. Thus, the spring 31 can be smoothly wound up. In addition, the components of the speed control gear mechanism 50 remain free from damage. Further, the planetary gear 43 is drawn in the counter-clockwise direction by the large gear section 41*a* revolving counter-clockwise and is moved counter-clockwise along the outer circumference of the large gear section 41*a*. The large gear section 43*a* of the planetary gear 43 is released from the small gear section 44*b* of the gear 44, so that the spring winding operation is not intercepted.

Figure 8:
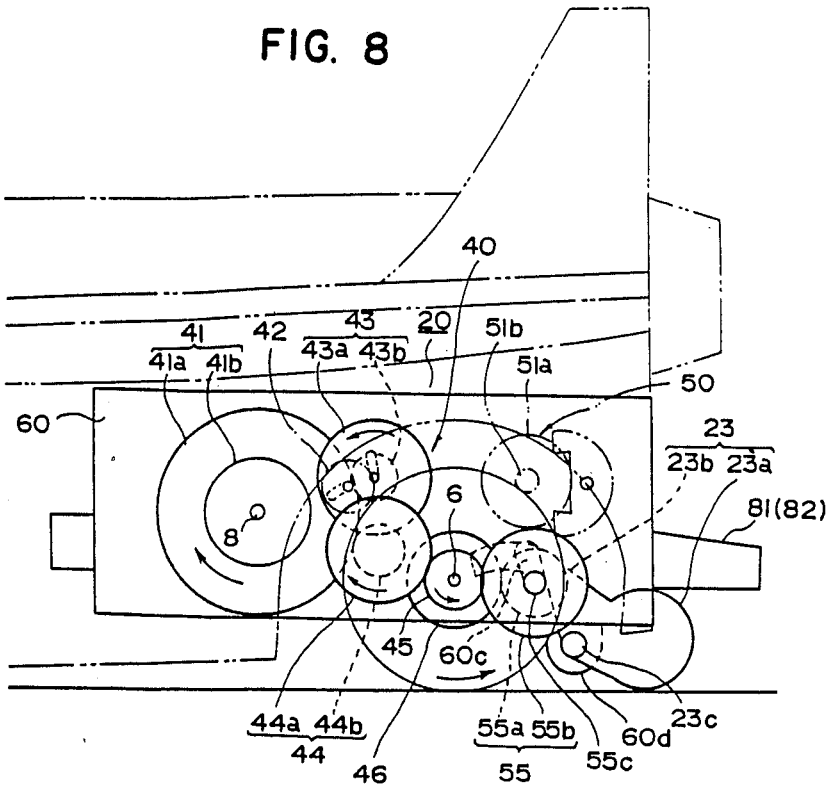
FIG. 8 is a schematic view showing the relation of gear engagement when the toy vehicle is rolling in the horizontal position by means of the driving wheels.

After the spring 31 has been wound and the toy vehicle 1 is released by the user, the driving wheels 21 are free from restriction. The wound spring 31 begins its returning movement and the gear 41 starts to revolve clockwise as represented by the arrow therein in FIG. 8. Then the planetary gear 43 moves clockwise along the outer circumference of the large gear section 41*a* and the large gear section 43*a* meshes with the small gear section 44*b* of the gear 44. According to this gear engagement, the revolution of the spring shaft 8 owing to the returning power of the wound spring 31 is accelerated, which is transmitted to the drive shaft 6. As a result, the drive shaft 6 and the drive wheels revolve counter-clockwise (FIG. 8). In this way, the walking-/rolling toy vehicle 1 rolls forward at a high speed. Simultaneously, the walking legs 81, 82 are moving as represented by the arrow M in FIG. 6 by the above-described mechanism. However, since the walking legs 81, 82 are isolated from the ground, the toy vehicle 1 does not walk.

Under this condition, the planetary gear 42 moves counter-clockwise along the large gear section 44*a* by the gear 44 revolving clockwise through the planetary gear 43 and is released from the small gear section 41*b* of the gear 41. Thus, the power transmission through the above gears can be executed without any trouble. Further, although the planetary gear 55 is subjected to a lifting force, i.e., a force in the counter-clockwise directon (in FIG. 8) along the transmission gear 46 by the transmission gear 46 revolving counter-clockwise accompanying the driving wheels 21, the planetary gear 55 is forcibly moved downwards against the lifting force by the actuating member 23 in the same manner as when the spring 31 is wound up. The planetary gear 55 is released from the gear 51*b* and the speed control gear mechanism 50 is in its rest position. Accordingly, driving wheels 21 revolve at a high speed.

On the other hand, when the walking/rolling toy vehicle 1 with a wound spring 31 is lifted and the ground contacting section 23*a* of the actuating member 23 is released from contact with the ground 100, the planetary gear 55 is free from restriction of the actuating member 23 and is lifted. The gear 55 is then moved counter-clockwise along the outer circumference of the transmission gear 46 by the power of the transmission gear 46 revolving counter-clockwise with the drive shaft 6. Then the planetary gear 55 meshes with the gear 51*b* and the speed control gear mechanism 50 is actuated, so that the spring 31 returning speed is shifted into the low speed mode. As a result, the revolutional speed of the driving wheels 21 and the walking speed of the walking legs 81, 82 are also reduced. As such, power loss under non-rolling conditions is reduced.

After the spring has been wound up and the walking-/rolling toy vehicle 1 is placed in the vertical position on the ground 100 through the auxiliary legs 12 and the standing support members 13, as shown in FIG. 1, the walking legs 81, 82 alternatively move to create a walking motion, i.e., one of the legs steps forward when it is isolated from the floor 100 and then kicks backwards.

Figure 9:
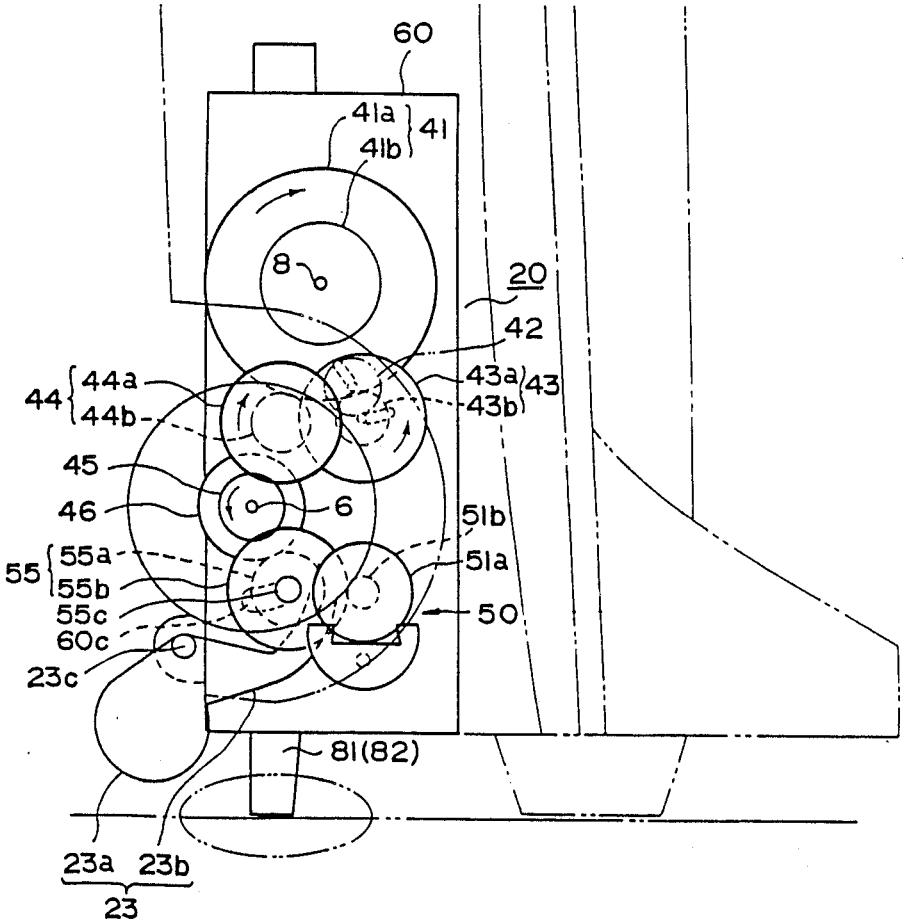
FIG. 9 is a schematic view showing the relation of gear engagement when the toy vehicle is walking in the vertical position.

As shown in FIG. 9, the planetary gear 55 is moved counter-clockwise along the outer circumference of the transmission gear 46 by the counter-clockwise revolution of the gear 46 and thus the large gear section 55*b* meshes with the gear 51*b*. According to this engagement, the speed control gear mechanism 50 is actuated so as to keep the revolutional speed low. Therefore, the toy vehicle 1 is capable of walking slowly.

As seen from the above, the walking/rolling toy vehicle 1 according to the present invention can execute both walking and rolling movements, and automatically switch the speed control gear mechanism between: (1) the rest position where the speed control gear mechanism is released from power by means of the actuating member and the planetary gear is moved by the actuating member when the spring is wound and the toy vehicle is rolling; and (2) the actuating position where the speed control gear mechanism is actuated to transmit the power when the toy is lifted or placed in a vertical position and the driving wheels are isolated from the ground while keeping the spring wound up. In other words, since the shifting operation between the high speed mode and the low speed mode is automatically performed, this toy eliminates manual operation and damage to the components of the speed control gear mechanism from the power transmitted to the speed control gear mechanism during winding of the spring.

Further, since the speed control gear mechanism can be actuated to switch into the low speed mode as soon as the walking-rolling toy is lifted while the spring is kept wound, power loss is decreased in comparison with conventional toy vehicles where the high revolving speed of the driving wheels is maintained whenever the driving wheels are isolated from the ground.

The foregoing is considered illustrative only of the principles of the invention. Further, since numerous modifications and changes will readily occur to those skilled in the art, it is not desired to limit the invention to the exact construction and operation shown and described. For example, although a particular configuration of the body 10 is shown, the body 10 could be configured in any number of variations. In addition, although the cams are described as being connected to the drive shaft, it is to be understood that, as suggested, a separate crank or rod with bent ends 180° out of phase with each other could be disposed for rotation in the unit casing, engaged with the large control openings formed centrally of the drive shaft through gears to effect rotation. Accordingly, all suitable modifications and equivalents may be resorted to, falling within the scope of the invention and the appended claims and their equivalents.

We claim:

1. A toy vehicle adapted for movement on a support surface, comprising:

(a) a body;

(b) power generating means connected to the body;

(c) a plurality of powered driving wheels connected to the power generating means through a transmission and extending from a first area of the body for moving the vehicle along the support surface while in a horizontal position;

(d) leg means arranged for reciprocating powered movement relative to the body to extend out of a second area of the body which is substantially perpendicular to the first area for moving the vehicle along the support surface while in a vertical position;

(e) crank means connected between the transmission and the leg means adapted to convert the power fed from the power generating means through the transmission into power for moving the leg means;

(f) movable gear means meshing with the transmission and moving in the direction of revolution of the transmission;

(g) power cut out/shifting means which is connected to and disconnected from the transmission by movement of the movable gear means between a first position and a second position; and (h) movable actuating means, including a first end connected to a second end, the first end of which moves when contacting the support surface when the body is in a horizontal position with the plurality of driving wheels contacting the support surface and the second end of which moves at the same time moving the movable gear means into the second position, wherein, when the movable gear means is in the first position and the vehicle is in the vertical position such that the the legs are contacting the support surface, the legs and plurality of powered driving wheels move at a first speed and effect a walking motion for the toy vehicle, and wherein, when the movable gear means is in the second position and the vehicle is in the horizontal position such that the wheels are contacting the support surface, the legs and plurality of powered driving wheels move at a second, faster speed and effect a rolling motion for the toy vehicle.

2. The toy vehicle as recited in claim 1, wherein the leg means comprises:

a pair of walking legs extending from the interior to the exterior of the body.

3. The toy vehicle as recited in claim 2, wherein the crank means comprises:

a pair of cams, each of which is connected to a leg and is adapted to convert the power fed from the power generating unit through the transmission into power to move the pair of walking legs, wherein each cam has a phase substantially different than the other.

4. The toy vehicle as recited in claim 3, wherein the movable gear means comprises:

a planetary gear meshing with a first gear of the transmission and revolving in the direction of revolution of the first gear of the transmission.

5. The toy vehicle as recited in claim 4, wherein the power generating means comprises a wind-up spring.

6. The toy vehicle as recited in claim 5, wherein the body is configured as an airplane.

7. A toy vehicle adapted for movement on a support surface comprising:

(a) a body;

(b) power generating means connected to the body;

(c) a plurality of driving wheels connected to the power generating means through a transmission and extending from a first area of the body for moving the vehicle along the support surface while in horizontal position;

(d) a pair of crank mechanisms, each of which is adapted to convert the revolutional driving power fed from the power generating means through the transmission into walking driving power with each crank having a phase substantially different than the other;

(e) a pair of powered legs for walking extending from a second area of the body which is substantially perpendicular to the first area for moving the vehicle along the support surface while in a vertical position, the legs being connected to the pair of crank mechanisms so that the walking driving power is fed to the legs to execute a walking motion;

(f) a planetary gear movable between a first position and a second position and meshing with a first gear of the transmission and revolving in the direction of revolution of the first gear of the transmission;

(g) power cut out/shifting means adapted to be driven in linkage with the first gear of the transmission by receiving the revolutional driving power from the planetary gear engaged therewith when the planetary gear in the first position; and (h) a movable, actuating member, including a first end and a second end, the first end of which moves when contacting the support surface when the body is in a horizontal position with the plurality of driving wheels contacting the support surface and the second end of which moves at the same time moving the planetary gear into the second position disengaged from the power cut out/shifting means, wherein, when the planetary gear is in the first position and the vehicle is in the vertical position such that the legs are contacting the support surface, the legs and the plurality of powered driving wheels move at a first speed to effect a walking motion for the toy vehicle, and wherein, when the planetary gear is in the second position and the vehicle is in the horizontal position such that the wheels are contacting the support surface, the legs and the plurality of powered driving wheels move at a second, faster speed to effect a rolling motion for the toy vehicle.

* * * * *